US011103062B2

(12) United States Patent
Calvert

(10) Patent No.: US 11,103,062 B2
(45) Date of Patent: Aug. 31, 2021

(54) HEIGHT-ADJUSTABLE MEDICINE CART

(71) Applicant: April Drusilla Calvert, Cedar Bluff, MS (US)

(72) Inventor: April Drusilla Calvert, Cedar Bluff, MS (US)

( * ) Notice: Subject to any disclaimer, the term of this patent is extended or adjusted under 35 U.S.C. 154(b) by 0 days.

(21) Appl. No.: 16/844,910

(22) Filed: Apr. 9, 2020

(65) Prior Publication Data

US 2020/0375355 A1 Dec. 3, 2020

Related U.S. Application Data

(63) Continuation-in-part of application No. 29/695,987, filed on Jun. 24, 2019, now Pat. No. Des. 925,044.

(60) Provisional application No. 62/854,239, filed on May 29, 2019.

(51) Int. Cl.
*A47B 67/02* (2006.01)
*A47B 51/00* (2006.01)

(52) U.S. Cl.
CPC ..... *A47B 67/02* (2013.01); *A47B 51/00* (2013.01); *A47B 2067/025* (2013.01)

(58) Field of Classification Search
CPC ... A47B 67/02; A47B 51/00; A47B 2067/025; A47B 96/067; A47B 96/008; A47B 96/06; A47B 96/061; A47B 96/07
USPC ..... 312/209, 330.1, 295
See application file for complete search history.

(56) References Cited

U.S. PATENT DOCUMENTS 446,647 A * 2/1891 Rankin
3,250,584 A * 5/1966 Tassell ..... A47B 57/565 312/247
3,563,626 A * 2/1971 Ferdinand ..... A47B 57/425 312/242
3,729,113 A * 4/1973 Lopatka ..... A47B 57/30 220/480
5,069,512 A * 12/1991 Sykes ..... E05D 5/0238 312/139.2

(Continued)

FOREIGN PATENT DOCUMENTS

WO WO2014148977 9/2014
WO WO2014148977 A1 9/2014

OTHER PUBLICATIONS

Hansen & Guldborg Møbler, Hansen & Guldborg Adjustable Teak Wall Cabinet, chairish.com.

*Primary Examiner* — Daniel J Troy
*Assistant Examiner* — Timothy M Ayres

(57) ABSTRACT

A height-adjustable medicine cart is an apparatus which eliminates the need for medical staff to push around traditional medicine carts. The apparatus includes a cabinet and a height adjustment mechanism. The cabinet is designed to safely store medical supplies and medicine. The cabinet facilitates the storage and retrieval of the contents while preventing access to the stored contents from unauthorized users. The height-adjustment mechanism enables the mounting of the cabinet adjacent to a wall while also enabling the users to adjust the height of the cabinet. The cabinet includes a receptacle body, and the height adjustment mechanism includes a first rail, a second rail, a first carriage, and a second carriage. The receptacle body stores the medical supplies and the medicine. The first carriage and the second carriage slidably connect the receptacle body to the first rail and the second rail to enable the height adjustment of the cabinet.

3 Claims, 7 Drawing Sheets

(56) References Cited

U.S. PATENT DOCUMENTS

| | | | | |
|---|---|---|---|---|
| 5,647,651 | A * | 7/1997 | Kim | A47B 67/00 312/209 |
| 6,439,676 | B1 * | 8/2002 | Badonic | D06F 95/002 312/212 |
| 6,663,201 | B2 * | 12/2003 | Herron, III | A47B 57/42 312/245 |
| 6,973,684 | B2 | 12/2005 | Yoo | |
| 7,775,000 | B2 | 8/2010 | Walker et al. | |
| 8,714,372 | B2 * | 5/2014 | Yogev | F16B 12/50 211/71.01 |
| 8,891,243 | B2 | 11/2014 | Tanaka et al. | |
| 9,739,083 | B2 * | 8/2017 | Hermann | E05B 65/0014 |
| 9,879,435 | B2 | 1/2018 | Kruger et al. | |
| 10,104,959 | B2 * | 10/2018 | Nilsson | A47F 5/103 |
| 2002/0084727 | A1 * | 7/2002 | Miller | A47B 96/00 312/205 |
| 2004/0168250 | A1 | 9/2004 | Yoo | |
| 2007/0018433 | A1 | 1/2007 | Sinnamon et al. | |
| 2009/0015121 | A1 * | 1/2009 | Sampson | A47B 67/02 312/242 |

* cited by examiner

HEIGHT-ADJUSTABLE MEDICINE CART

The current application claims a priority to the U.S. Provisional Patent application Ser. No. 62/854,239 filed on May 29, 2019.

FIELD OF THE INVENTION

The present invention relates generally to medical furniture and appliances. More specifically, the present invention provides a height-adjustable medicine cart which facilitates the access to various medical supplies and medicine to users while keeping the stored items safe from unauthorized access.

BACKGROUND OF THE INVENTION

Medical furniture such as medical carts have been designed over the years to facilitate the work of healthcare staff in busy environments. Mobile carts have been used more often in medical facilities to enable the staff to push them around as necessary. However, pushing these carts is a hassle, and after long shifts it becomes a burden to the staff. There are also the traditional medical furniture which are provided in the different rooms of medical facilities. Unfortunately, the various furniture are often fixed, which prevents the staff from adjusting them to meet the staff needs.

An objective of the present invention is to provide a height-adjustable medicine cart, a new platform designed to safely store and distribute medicine and medical supplies. The height-adjustable medicine cart, preferably referred to as the MEDBUBBLE, is a stationary cart which can be height adjusted to match the height of the user. The height-adjustable medicine cart prevents strain on medical staff from pushing and pulling on heavy medicine carts. The height-adjustable medicine cart provides various operational features which facilitate the operation of the present invention by any user, such as comprising a light-weight structure, easy installation, etc. Further, the height-adjustable medicine cart provides various features which improve the operation and safety of the device, such as easy-to-access storage spaces, custom spaces for specific tools and medicine, and multiple locking mechanisms to prevent unauthorized access to medicine.

The height-adjustable medicine cart can be mounted adjacent to a wall utilizing a height adjustment mechanism. The height adjustment mechanism enables users to safely adjust the height of the medicine cart, effortlessly. The medicine cart is slidably mounted onto the height adjustment mechanism and can be locked at a desired position for comfortable use. The present invention further includes multiple storage spaces distributed within the medicine cart to receive multiple items including, but not limited to, medicine, medical tools, etc. Furthermore, a lockable compartment is provided to prevent access to specific items, such as narcotics or delicate medical instruments, from unauthorized users.

DETAIL DESCRIPTIONS OF THE INVENTION

All illustrations of the drawings are for the purpose of describing selected versions of the present invention and are not intended to limit the scope of the present invention.

Figure 1:
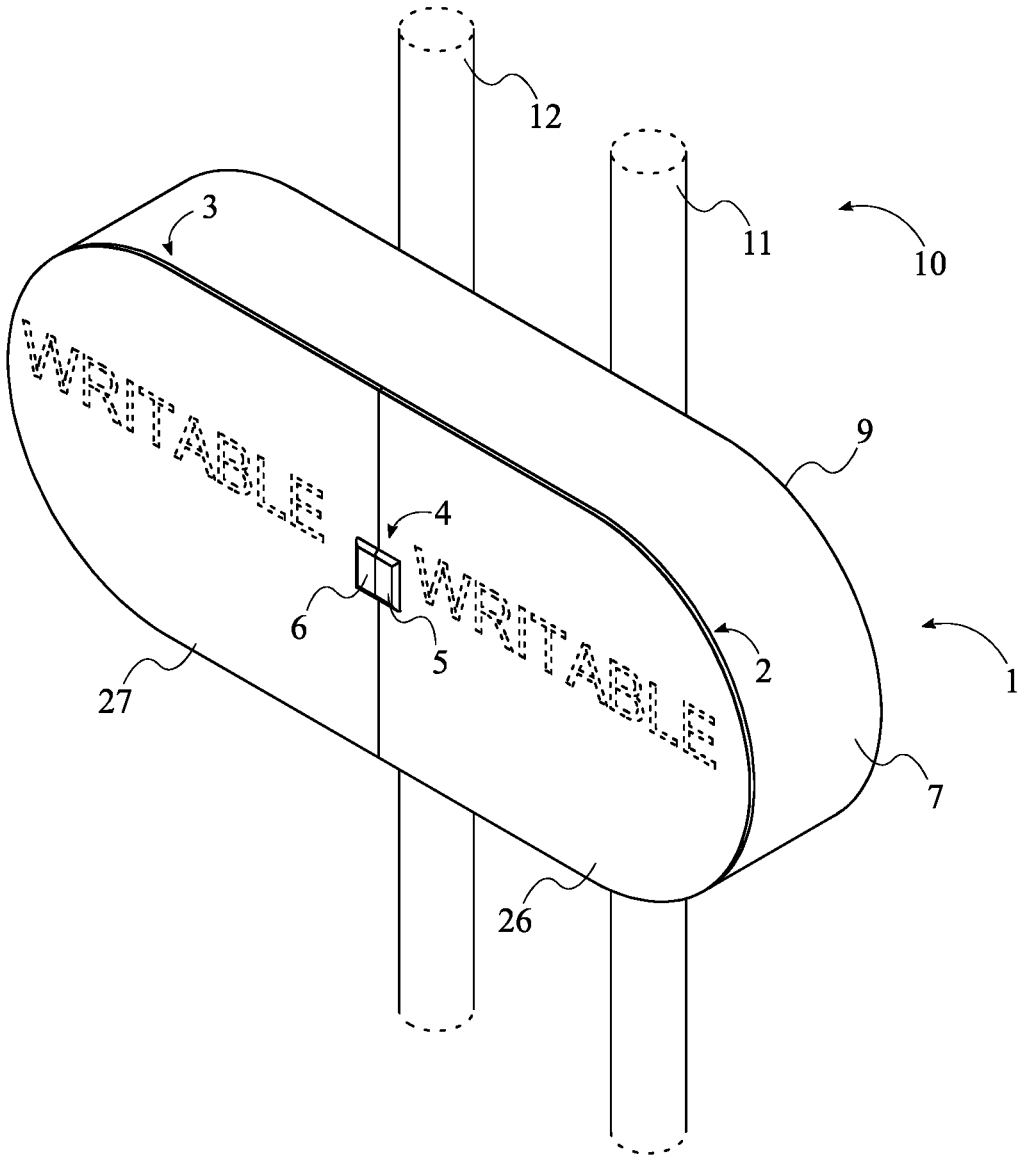
FIG. 1 is a top front left perspective view of the present invention showing the cabinet of the height-adjustable medicine cart.
Figure 2:
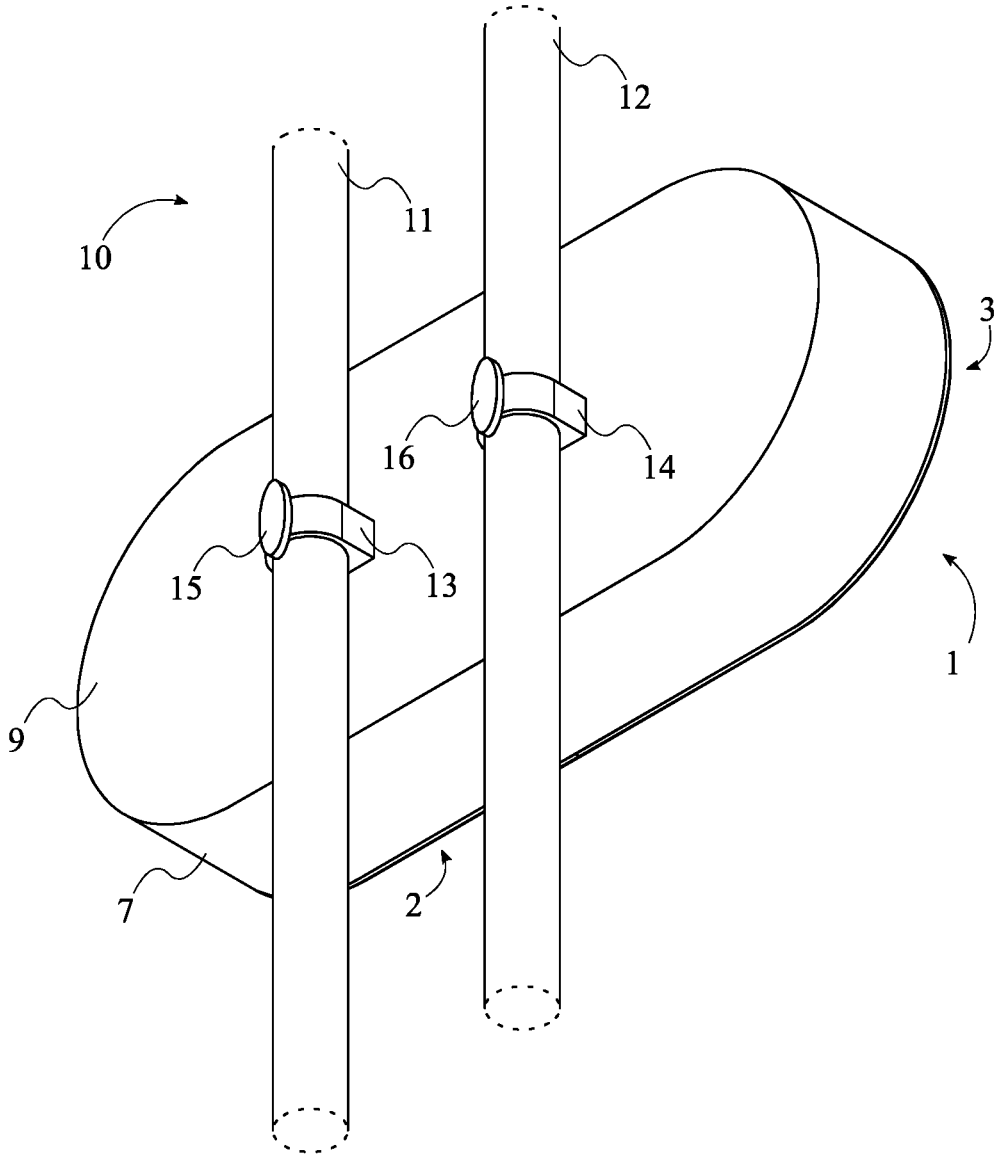
FIG. 2 is a bottom rear right perspective view of the present invention showing the height adjustment mechanism of the height-adjustable medicine cart.

The present invention provides a height-adjustable medicine cart. The height-adjustable medicine cart eliminates the need for medical staff to push around a medicine cart and is accessible to users of different heights. As can be seen in FIGS. 1 and 2, in a preferred embodiment, the present invention comprises a cabinet 1 and a height adjustment mechanism 10. The cabinet 1 is designed to safely store different medical supplies as well as medicine at an accessible location. The cabinet 1 further prevents access to the medical supplies and the medicine from unauthorized personnel. The height-adjustment mechanism 10 enables the mounting of the cabinet 1 adjacent to a wall and facilitates the height adjustment of the cabinet 1 without having to remove the cabinet 1 from the height-adjustment mechanism 10. Thus, users can easily reach any medical supply or medicine stored within the cabinet 1.

Figure 3:
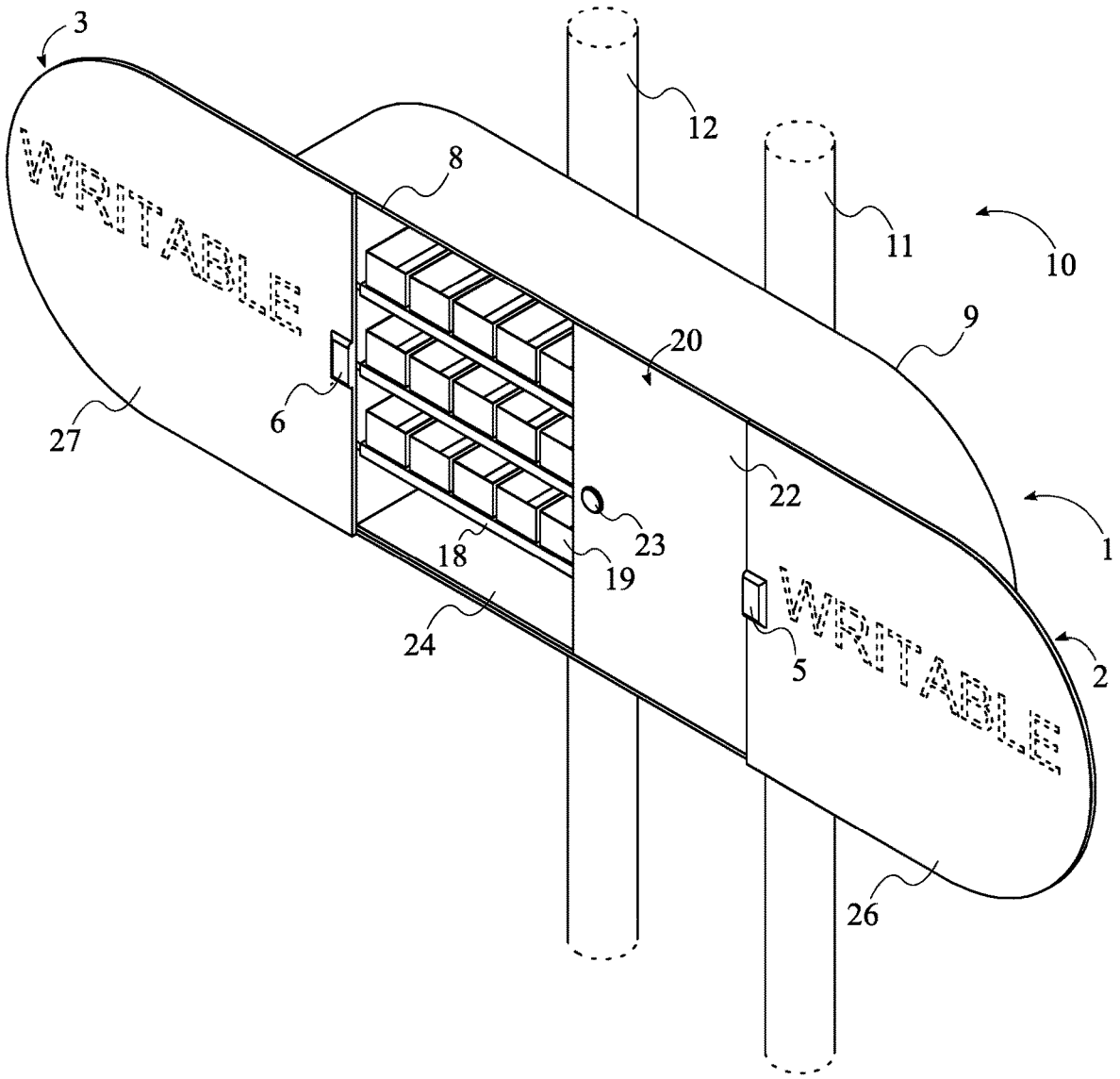
FIG. 3 is a top front left perspective view of the present invention showing the first door and the second door in an open configuration to expose the interior of the cabinet.

The general configuration of the aforementioned components allows the present invention to efficiently and effectively provide access to medical supplies to medical staff without the staff having to push around traditional medicine carts. As can be seen in FIG. 1 through 3, the cabinet 1 comprises a first door 2, a second door 3, and a receptacle body 7. The height adjustment mechanism 10 comprises a first rail 11, a second rail 12, a first carriage 13, a second carriage 14, a first clamping mechanism 15, and a second clamping mechanism 16. The receptacle body 7 has an elongated hollow design that is large enough to hold the desired number of medical supplies and medicine. The receptacle body 7 also has round lateral ends to form a bubble-like shape to maximize the storage space within the receptacle body 7 while maintaining a pleasing aesthetic. The receptacle body 7 comprises a front opening 8 and a backing 9. The front opening 8 is positioned opposite to the backing 9 about the receptacle body 7 to provide an access into the storage space within the receptacle body 7. The first carriage 13 and the second carriage 14 are externally positioned to the receptacle body 7, and the first carriage 13 and the second carriage 14 are also connected onto the backing 9, which prevents the attachment of the receptacle body 7 to the first rail 11 and the second rail 12 from interfering with a user accessing the contents of the present invention through the front opening 8. The first carriage 13 and the second carriage 14 each has an open-ended ring design that is able to support the weight of the cabinet 1. The first rail 11 and the second rail 12 are mounted parallel and offset from each other in order to move the receptacle body 7 along a vertical path. The first rail 11 and the second rail 12 each comprises an elongated rail body with a length large enough to accommodate different heights of users. The first rail 11 and the second rail 12 are each preferably connected adjacent to a wall in between the ceiling and the floor of the room where the present invention is desired to be installed. The first carriage 13 is slidably connected along the first rail 11, and the second carriage 14 is slidably connected along the second rail 12. Thus, the first carriage 13 and the second carriage 14 along with the receptacle body 7 can slide along the first rail 11 and the second rail 12.

Figure 7:
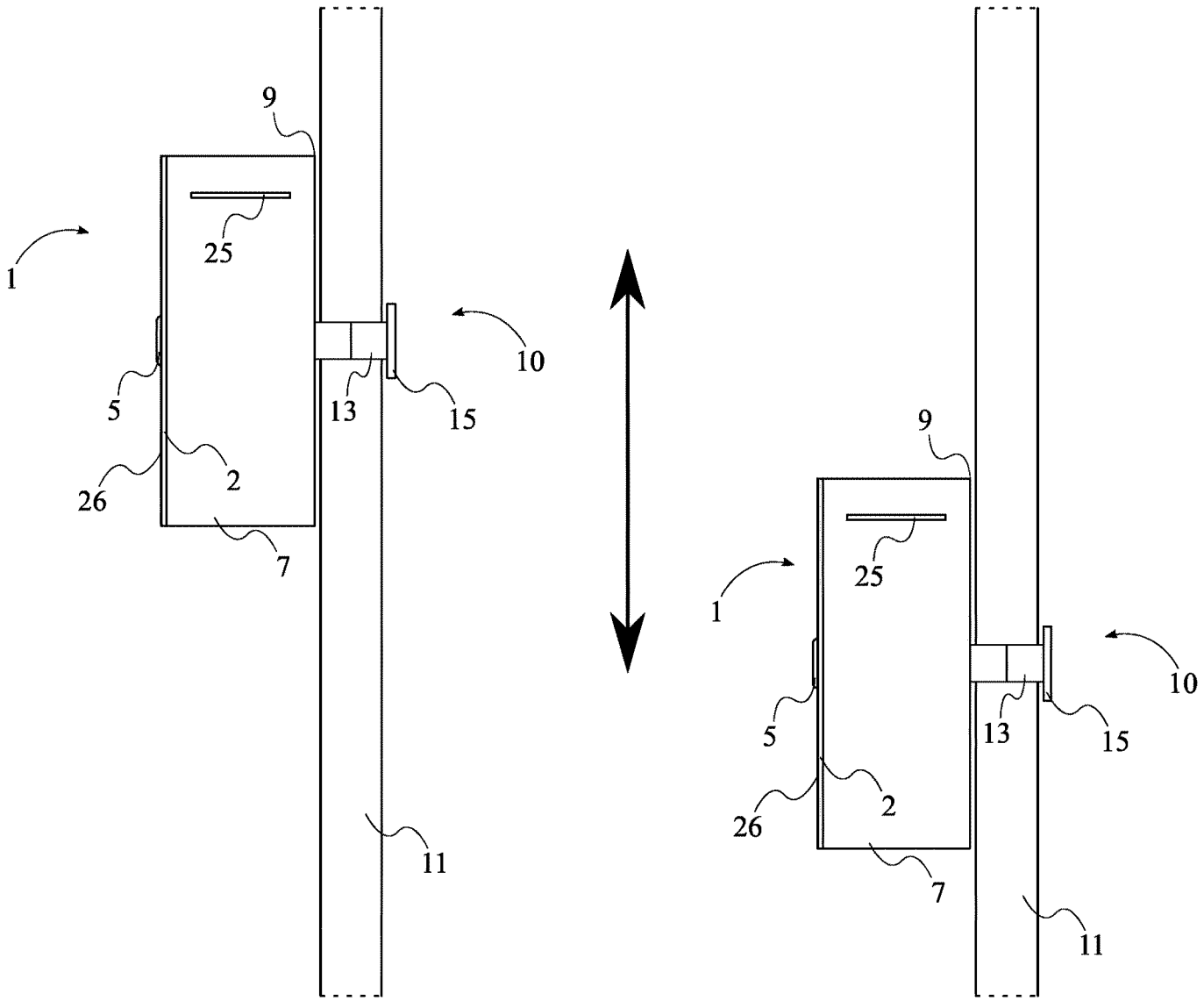
FIG. 7 is a left view of the present invention illustrating the height adjustment of the cabinet by utilizing the height adjustment mechanism.

As can be seen in FIGS. 3 and 7, the first clamping mechanism 15 is operatively integrated into the first carriage 13, wherein the first clamping mechanism 15 is used to lock the first carriage 13 in place along the first rail 11. Likewise, the second clamping mechanism 16 is operatively integrated into the second carriage 14, wherein the second clamping mechanism 16 is used to lock the second carriage 14 in place along the second rail 12. The first clamping mechanism 15 and the second clamping mechanism 16 each can be a mechanical clamping mechanism which is manually engaged or disengaged, such as screw-knob assembly. Thus, the user can adjust the position of the receptacle body 7 along the first rail 11 and the second rail 12 by first disengaging the first clamping mechanism 15 and the second clamping mechanism 16, sliding the receptacle body 7 along the first rail 11 and the second rail 12 to the desired position, and locking the receptacle body 7 in place by engaging the first clamping mechanism 15 and the second clamping mechanism 16. Finally, to maintain the medical supplies safely stored within the receptacle body 7, the first door 2 and the second door 3 are slidably mounted onto the receptacle body 7, adjacent to the front opening 8. As can be seen in FIG. 1 through 3, the first door 2 and the second door 3 each comprises a door body with a design that matches the design of its corresponding half of the receptacle body 7. In a closed configuration, the first door 2 and the second door 3 are positioned adjacent to each other, fully covering the front opening 8. In an open configuration, the first door 2 and the second door 3 are each slid away from each other along the length of the receptacle body 7 to expose the front opening 8. The first door 2 and the second door 3 can be operated individually or together to selectively expose portions of the receptacle body 7. In alternate embodiments, the cabinet 1 and the height-adjustment mechanism 10 can be modified to store non-medical items which require additional support. The first door 2 and the second door 3 can each also be slid parallel to the first rail 11 and the second rail 12, up or down, to have access into the receptacle body 7.

Figure 4:
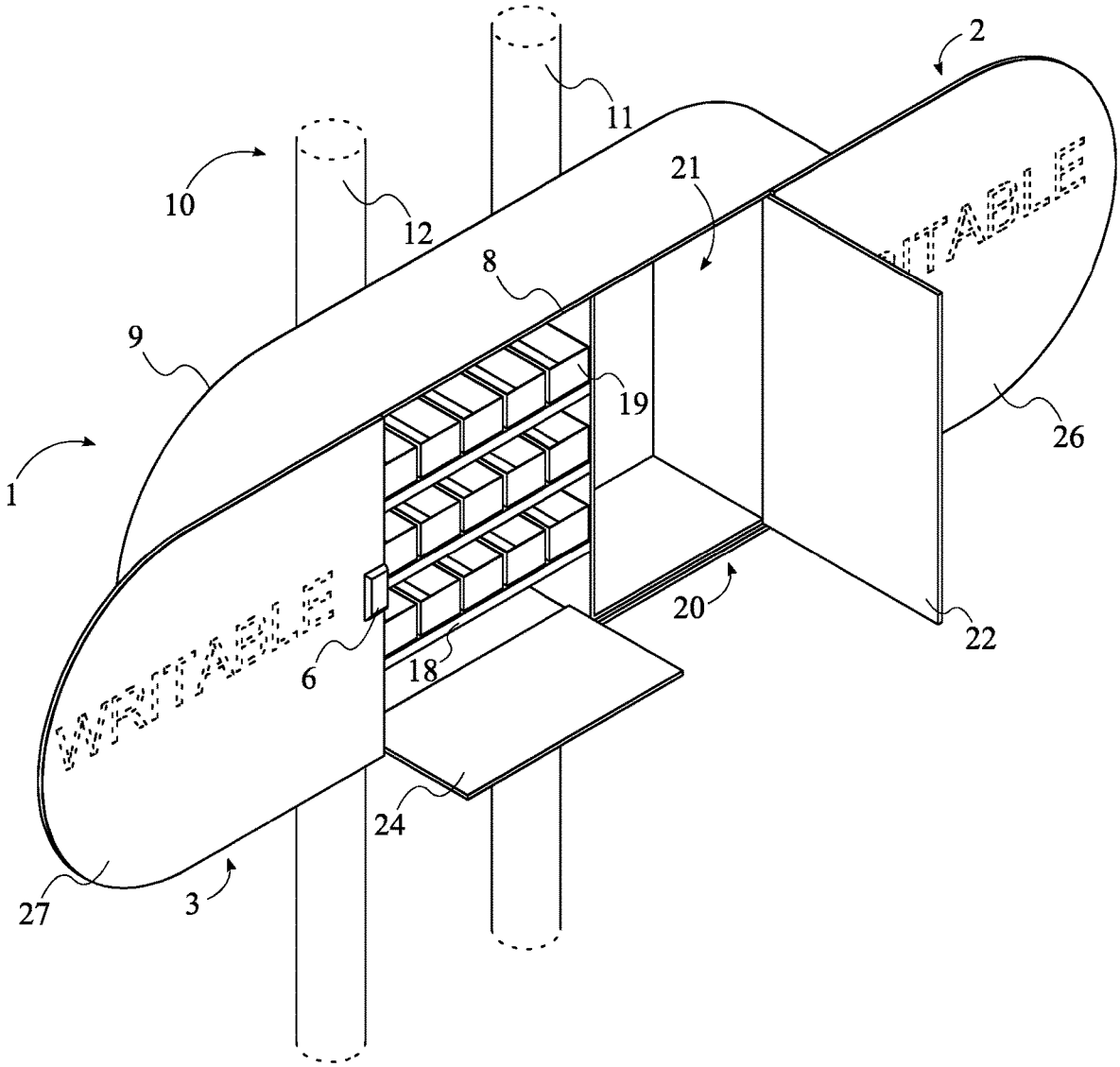
FIG. 4 is a top front right perspective view of the present invention showing the at least one securement door in an open configuration to expose the interior of the at least one lockable compartment.
Figure 5:
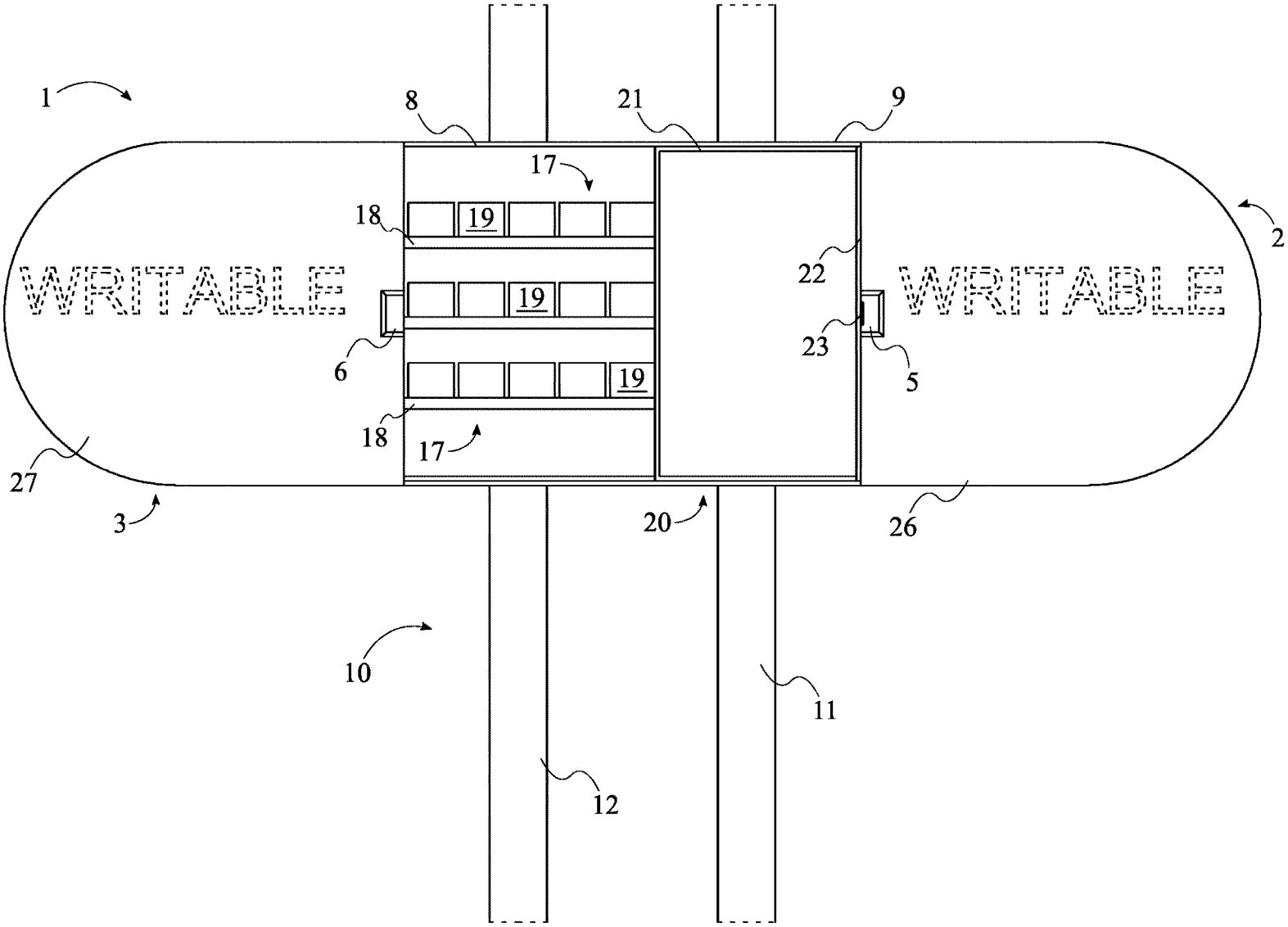
FIG. 5 is a front view of the present invention showing the plurality of shelf assemblies within the receptacle body of the cabinet.

The receptacle body 7 is preferably designed to hold medical supplies and medicine. As can be seen in FIG. 3 through 5, to protect delicate medical supplies or dangerous medicine from unauthorized access, the present invention may further comprise at least one lockable compartment 20. The at least one lockable compartment 20 is designed to store the medicine or medical supplies that can only be accessed by authorized users. The at least one lockable compartment 20 is mounted within the receptacle body 7 to maintain its contents hidden from view. The at least one lockable compartment 20 is also positioned adjacent to the first door 2 so that the at least one lockable compartment could be access by only opening the first door 2.

To prevent unauthorized access to the at least one lockable compartment 20, the present invention may further comprise at least one securement door 22 and at least one locking mechanism 23. As can be seen in FIGS. 4 and 5, the at least one lockable compartment 20 comprises a compartment opening 21 that allows a user to access the interior space of the at least one lockable compartment 20. The compartment opening 21 is positioned adjacent to the front opening 8 to facilitate access to the at least one lockable compartment 20 through the front opening 8. The at least one securement door 22 is hingedly connected to the at least one lockable compartment 20, adjacent to the compartment opening 21, which allows the at least one securement door 22 to readily close the at least one lockable compartment 20. Further, the at least one locking mechanism 23 is operatively coupled in between the at least one lockable compartment 20 and the at least one securement door 22, wherein the at least one locking mechanism 23 is used to selectively lock the at least one securement door 22 to the at least one lockable compartment 20. The at least one locking mechanism 23 can be a tumbler mechanism which requires a key to selectively lock/unlock the at least one locking mechanism 23. The at least one locking mechanism 23 can also be an electronic locking mechanism which utilizes biometric data so only preauthorized users can access the at least one lockable compartment 20. In further embodiments, the at least one lockable compartment 20 can be modified to store other important items.

In addition to the at least one lockable compartment 20, the present invention may further comprise a plurality of shelf assemblies 17 where users can place various items. As can be seen in FIG. 5, the plurality of shelf assemblies 17 is mounted within the receptacle body 7 to keep the stored items within the receptacle body 7. The plurality of shelf assemblies 17 is also positioned adjacent to the second door 3 to utilize the space within the receptacle body 7 not used by the at least one lockable compartment 20. In alternate embodiments, the plurality of shelf assemblies 17 can be replaced with cubicles or similar storage assemblies.

The plurality of shelf assemblies 17 is designed to facilitate the storage and retrieval of medical supplies within the receptacle body 7. As can be seen in FIG. 3 through 5, each of the plurality of shelf assemblies 17 comprises a support shelf 18 and at least one tray 19. The support shelf 18 of each of the plurality of shelf assemblies 17 is positioned parallel and offset from each other to leave enough space for the items to be placed on top of the support shelf 18. The support shelf 18 is preferably a panel that is strong enough to support the weight of the items to be stored on top of the support shelf 18. The first rail 11 and the second rail 12 are positioned normal to the support shelf 18 of each of the plurality of shelf assemblies 17 to prevent the items placed on top of the support shelf 18 from falling off. The at least one tray 19 is situated upon the support shelf 18 to receive the items to be stored on the support shelf 18. The at least one tray 19 can preferably be a plurality of trays that are used to safely retain and organize medical supplies. The plurality of trays can be distributed across the support shelf 18 to receive multiple items on the same support shelf 18. The at least one tray 19 can also comprise at least one label which enables the user to identify what is stored on the at least one tray 19. In further embodiments, the plurality of shelf assemblies 17 can be modified to store non-medical supplies.

In addition to the plurality of shelf assemblies 17, the present invention may further comprise a deployable shelf 24 which can be utilized to prepare the medicine, to setup the medical tools, to take notes, etc. As can be seen in FIGS. 3 and 4, the deployable shelf 24 is slidably mounted into the receptacle body 7 so that the deployable shelf 24 is stored within the receptacle body 7 when not in use and can be pulled out of the receptacle body 7 when in use. The deployable shelf 24 has a rectangular thin design that can support the items being placed on top. The first rail 11 and the second rail 12 are positioned normal to the deployable shelf 24 so the items positioned on top of the deployable shelf 24 do not fall off the deployable shelf 24. In alternate embodiments, the deployable shelf 24 can be modified to be deployed using other non-sliding mechanisms.

Figure 6:
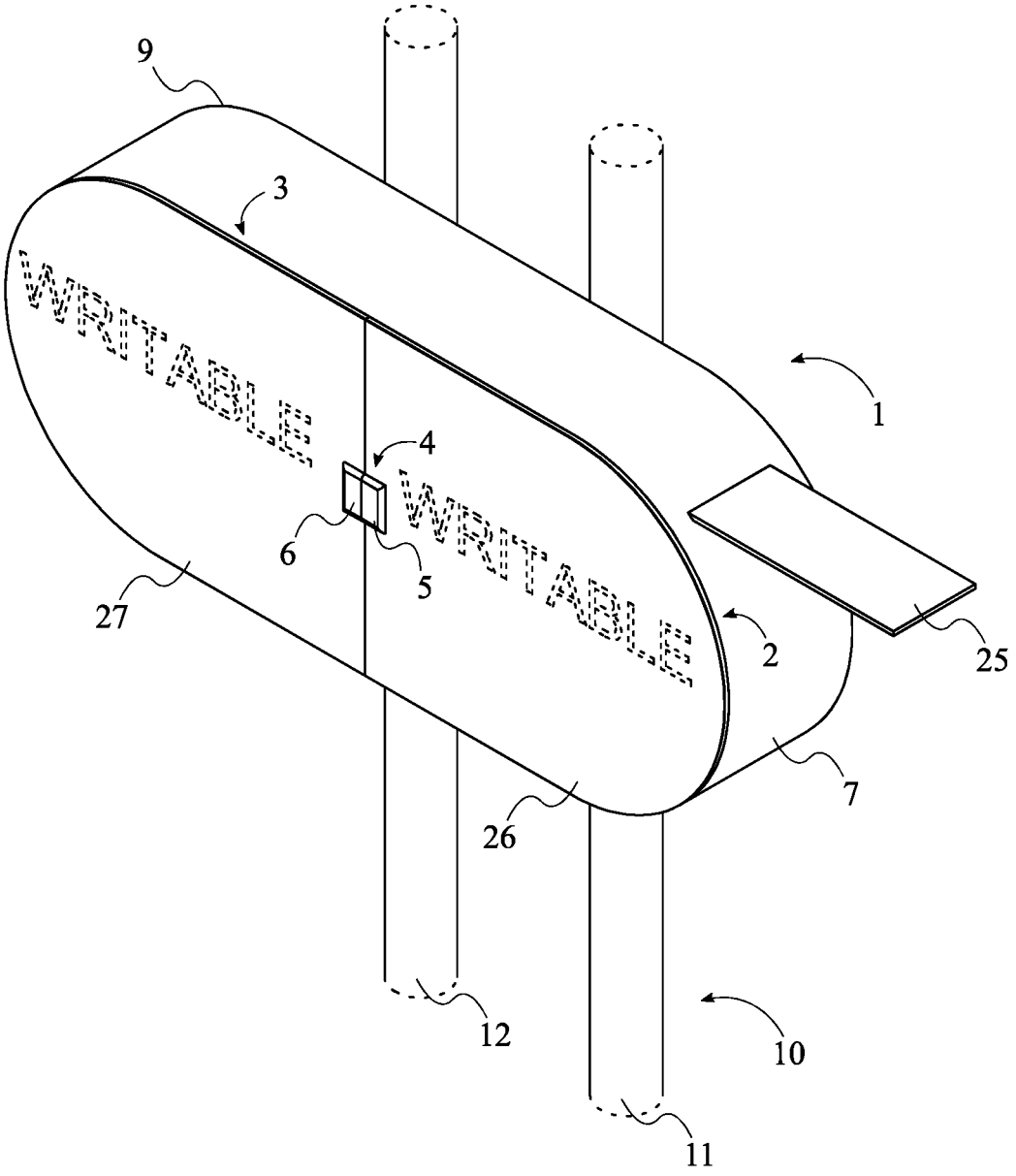
FIG. 6 is a top front left perspective view of the present invention showing the peripheral shelf attached to the receptacle body.

Like the deployable shelf 24, the present invention may further comprise a peripheral shelf 25 which is designed to support computing devices such as a laptop. As can be seen in FIGS. 6 and 7, the peripheral shelf 25 is externally attached to the receptacle body 7 to hold the computing device adjacent to the receptacle body 7. The peripheral shelf 25 has an elongated rectangular design that is large enough to support the computing device. The peripheral shelf 25 is preferably attached to the side of the receptacle body 7, adjacent to the first door 2, so that the computing device does not obstruct the access of the user into the receptacle body 7. The peripheral shelf 25 is preferably attached to the receptacle body 7 using multiple slits provided on the receptacle body 7 to receive multiple protrusions positioned on an end of the peripheral shelf 25. Further, the first rail 11 and the second rail 12 is positioned normal to the peripheral shelf 25 to prevent the computing device from falling off the peripheral shelf 25. In further embodiments, the receptacle body 7 can be equipped with electronic capabilities compatible with common computing devices, such as Wi-Fi, charging capabilities, etc.

To provide additional security, the present invention further comprises a door lock mechanism 4 to keep the cabinet 1 locked when not in use. The door lock mechanism 4 is different from the at least one locking mechanism 23 as the door lock mechanism 4 can be accessed by a wider range of users. As can be seen in FIGS. 1 and 3, the door lock mechanism 4 comprises a first interlocking portion 5 and a second interlocking portion 6. The first interlocking portion 5 is mounted onto the first door 2, while the second interlocking portion 6 is mounted onto the second door 3. The first interlocking portion 5 and the second interlocking portion 6 are oriented on the first door 2 and the second door 3 so that, when the first door 2 is positioned adjacent to the second door 3, the first interlocking portion 5 is positioned adjacent to the second interlocking portion 6 to engage with the second interlocking portion 6. Like the at least one locking mechanism 23, the door lock mechanism 4 can be a mechanical locking mechanism which requires a key to be locked/unlocked. The door lock mechanism 4 can also be an electronic locking mechanism which utilizes biometric data to enable the access of a wider range of medical staff into the receptacle body 7. The medical staff can have access to both the door lock mechanism 4 and the at least one locking mechanism 23 or just the door lock mechanism 4. In further embodiments, the door lock mechanism 4 can comprise an alarm system to alert users of unauthorized access.

To provide greater functionality to users who have work in a fast-paced environment, the present invention further comprises a first inscribable board 26 and a second inscribable board 27 where the users can write notes, reminders, patient information, etc. As can be seen in FIGS. 1 and 7, the first inscribable board 26 is connected across the first door 2, opposite the receptacle body 7, so the first inscribable board 26 can be accessed at any time. Likewise, the second inscribable board 27 is connected across the second door 3, opposite the receptacle body 7, so the second inscribable board 27 can also be accessed at any time without having to unlock the cabinet 1. The first inscribable board 26 and the second inscribable board 27 can each be whiteboards, chalkboards, etc. In further embodiments, the present invention includes additional features that facilitate the care of patients.

Although the invention has been explained in relation to its preferred embodiment, it is to be understood that many other possible modifications and variations can be made without departing from the spirit and scope of the invention as hereinafter claimed.

What is claimed is:

1. A height-adjustable medicine cart comprising:

a cabinet;

a height adjustment mechanism;

the cabinet comprising a first door, a second door and a receptacle body;

the height adjustment mechanism comprising a first rail, a second rail, a first carriage, a second carriage, a first clamping mechanism and a second clamping mechanism;

the receptacle body comprising a front opening and a backing;

the front opening being positioned opposite to the backing about the receptacle body;

the first carriage and the second carriage being externally positioned to the receptacle body;

the first carriage and the second carriage being connected onto the backing;

the first rail and the second rail being mounted parallel and offset from each other;

the first carriage being slidably connected along the first rail;

the first clamping mechanism being operatively integrated into the first carriage, wherein the first clamping mechanism is used to lock the first carriage in place along the first rail;

the second carriage being slidably connected along the second rail;

the second clamping mechanism being operatively integrated into the second carriage, wherein the second clamping mechanism is used to lock the second carriage in place along the second rail;

the first door and the second door being slidably mounted onto the receptacle body, adjacent to the front opening;

at least one lockable compartment;

the at least one lockable compartment being mounted within the receptacle body;

the at least one lockable compartment being positioned adjacent to the first door;

at least one securement door;

at least one locking mechanism;

the at least one lockable compartment comprising a compartment opening;

the compartment opening being positioned adjacent to the front opening;

the at least one securement door being hingedly connected to the at least one lockable compartment, adjacent to the compartment opening;

the at least one locking mechanism being operatively coupled in between the at least one lockable compartment and the at least one securement door, wherein the at least one locking mechanism is used to selectively lock the at least one securement door to the at least one lockable compartment;

a plurality of shelf assemblies;

the plurality of shelf assemblies being mounted within the receptacle body;

the plurality of shelf assemblies being positioned adjacent to the second door;

a deployable shelf;

the deployable shelf being slidably mounted into the receptacle body;

the first rail and the second rail being positioned normal to the deployable shelf;

a door lock mechanism;

the door lock mechanism comprising a first interlocking portion and a second interlocking portion;

the first interlocking portion being mounted onto the first door;

the second interlocking portion being mounted onto the second door;

a first inscribable board;

the first inscribable board being connected across the first door, opposite the receptacle body;

a second inscribable board;

the second inscribable board being connected across the second door, opposite the receptacle body; and the first inscribable board and the second inscribable board each being a whiteboard or a chalkboard.

2. The height-adjustable medicine cart as claimed in claim 1 comprising:

each of the plurality of shelf assemblies comprises a support shelf and at least one tray;

the support shelf of each of the plurality of shelf assemblies being positioned parallel and offset from each other;

the first rail and the second rail being positioned normal to the support shelf of each of the plurality of shelf assemblies; and, the at least one tray being situated upon the support shelf.

3. The height-adjustable medicine cart as claimed in claim 1 comprising:

a peripheral shelf;

the peripheral shelf being externally attached to the receptacle body; and, the first rail and the second rail being positioned normal to the peripheral shelf.

* * * * *